US006059024A

United States Patent [19]

Ramshaw et al.

[11] Patent Number: 6,059,024

[45] Date of Patent: May 9, 2000

[54] POLYMER FILM HEAT EXCHANGER

[75] Inventors: Colin Ramshaw; Roshan Jeet Jee Jachuck, both of New Castle Upon Tyne, United Kingdom

[73] Assignee: Newcastle University Ventures Ltd., Newcastle upon Tyne, United Kingdom

[21] Appl. No.: 09/029,428

[22] PCT Filed: Sep. 4, 1996

[86] PCT No.: PCT/GB96/02189

§ 371 Date: Mar. 5, 1998

§ 102(e) Date: Mar. 5, 1998

[87] PCT Pub. No.: WO97/09579

PCT Pub. Date: Mar. 13, 1997

[30] Foreign Application Priority Data

Sep. 8, 1995 [GB] United Kingdom ..... 9518260

[51] Int. Cl.[7] ..... F28F 3/00

[52] U.S. Cl. ..... 165/166; 165/905

[58] Field of Search ..... 165/905, 46, 166

[56] References Cited

U.S. PATENT DOCUMENTS

| | | | |
|---|---|---|---|
| 3,216,492 | 11/1965 | Weaver | 165/46 |
| 3,256,930 | 6/1966 | Norback | 165/905 |
| 4,354,546 | 10/1982 | Zinn | 165/46 |
| 5,050,671 | 9/1991 | Fletcher . | |
| 5,626,188 | 5/1997 | Dewar et al. | 165/905 |
| 5,671,804 | 9/1997 | Kordelin | 165/46 |

FOREIGN PATENT DOCUMENTS

| | | | |
|---|---|---|---|
| 10817 | 5/1980 | European Pat. Off. | 165/905 |
| 0065679 | 12/1982 | European Pat. Off. . | |
| 97905 | 1/1984 | European Pat. Off. | 165/905 |
| 0397487 | 11/1990 | European Pat. Off. . | |
| 2523287 | 9/1983 | France . | |
| 835008 | 3/1952 | Germany . | |
| 2645072 | 4/1978 | Germany . | |
| 3418561 | 11/1985 | Germany | 165/905 |
| 57-117796 | 7/1982 | Japan | 165/905 |
| 5895 | 1/1983 | Japan | 165/905 |
| 58-124196 | 7/1983 | Japan | 165/905 |
| 58-175794 | 10/1983 | Japan | 165/905 |
| 60-86391 | 5/1985 | Japan | 165/905 |
| 926502 | 5/1982 | U.S.S.R. | 165/905 |

OTHER PUBLICATIONS

Jachuck, Ramshaw et al. trans IchemE, vol. 72, part A, Mar. 1994.

Jachuck, Ramshaw et al., BHR Conference Series, Pub No. 18, Mechanical Engineering Publications Ltd., London, ISBN 0 85 298 9784 P19–25.

*Primary Examiner*—Ira S. Lazarus
*Assistant Examiner*—Terrell McKinnon
*Attorney, Agent, or Firm*—Fulbright & Jaworski, LLP

[57] ABSTRACT

A bilayer of polymer film arranged in a manner to create respective flow paths for a first and second gaseous or liquid fluid, wherein the ratio of the surface area of polymer film adapted to contact and thereby isolate both fluids to the total matrix volume is in excess of 700 $m^2/m^3$, processes for the preparation thereof, heat exchangers comprising such bilayers and uses thereof.

13 Claims, 4 Drawing Sheets

POLYMER FILM HEAT EXCHANGER

BACKGROUND

The present invention relates to novel polymer film bilayers for non mixing contact of fluids, heat exchangers comprising such bilayers, the preparation and uses thereof, in particular to polymer film heat exchangers having a favourable ratio of heat exchanging surface area to path length of gas and/or liquids, processes for the preparation thereof and applications thereof.

In recent years polymers have become available with working temperatures up to and beyond 250° C. Some typical examples are polyether ether ketone (PEEK) and poly imide (UPILEX). Since the chemical and fouling resistance of these materials is usually attractive, there is an emerging opportunity for them to displace metals in the construction of heat exchangers which operate at ≦250° C.

The thermal conductivity of polymers is poor compared with that of metals so it is important that the thickness of polymer used does not impose a significant extra thermal resistance upon the heat transfer process. This implies that polymer film having a thickness of 100 microns is typically an appropriate choice for a gas-liquid heat transfer duty. The film is corrugated so that adjacent film layers may be held apart by the corrugations which cross at approximately 90°. Where heat is being transferred from fluid A to fluid B, these fluids flow alternately through layers of corrugated film.

As a result of exploratory studies recently completed, it is now known that the heat transfer performance of a simple corrugated film matrix is very high using corrugations.having a peak to peak dimension of approximately 2 mm and a corrugation height of approximately 1 mm. However, in view of the relatively high pressure drop per unit flow path length, compared with that encountered in conventional metal heat exchangers, the flow paths must be minimised. This requirement applies particularly to the gas flow path length, when heat is being transferred between gases and liquids, eg in a domestic gas water heater. Recent ("condensing") versions of these heaters include secondary heat exchangers which cool combustion products from 250° C. to 50° C. approximately, thereby improving their overall thermal efficiency. Since the condensate produced in these units is weakly acidic the secondary heat exchanger is constructed in stainless steel. This entails a significant extra cost compared with the usual cast iron unit and provides an opportunity for a relatively cost effective construction in polymer film.

However, due to the limited flue gas pressure drop available, a secondary heat exchanger based upon a polymer film matrix, with its narrow flow channels, must involve a gas flow path length of only 10 cm or so. This invention is concerned with a novel design for achieving that requirement economically. While the design is particularly relevant to flue gas cooling with liquids, it also has significance for any gas-liquid heat transfer operation where the gas pressure drop is restricted.

SUMMARY

In its broadest aspect the present invention relates to a bilayer of polymer film arranged in manner to create respective flow paths for a first and second gaseous or liquid fluid, wherein the ratio of the surface area of polymer film adapted to contact and thereby isolate both fluids to the total matrix volume is in excess of 700 $m^2/m^3$. Preferably the ratio is in excess of 1000 $m^2/m^3$, for example is of the order of 1500 $m^2/m^3$. It is a particular advantage that these ratios may be obtained with use of a polymer, with associated manufacturing efficiency, and with acceptable pressure drop. By means of the bilayer of the present invention it is possible to provide a total surface area to path length of heat exchanging gas and liquid which is economically attractive and yet wherein the bilayer is such as to ensure acceptable pressure drop, thereby avoiding leakage and failure thereof. The bilayer is ideally suited for use in heat exchanging application.

DETAILED DESCRIPTION

Figure 1:
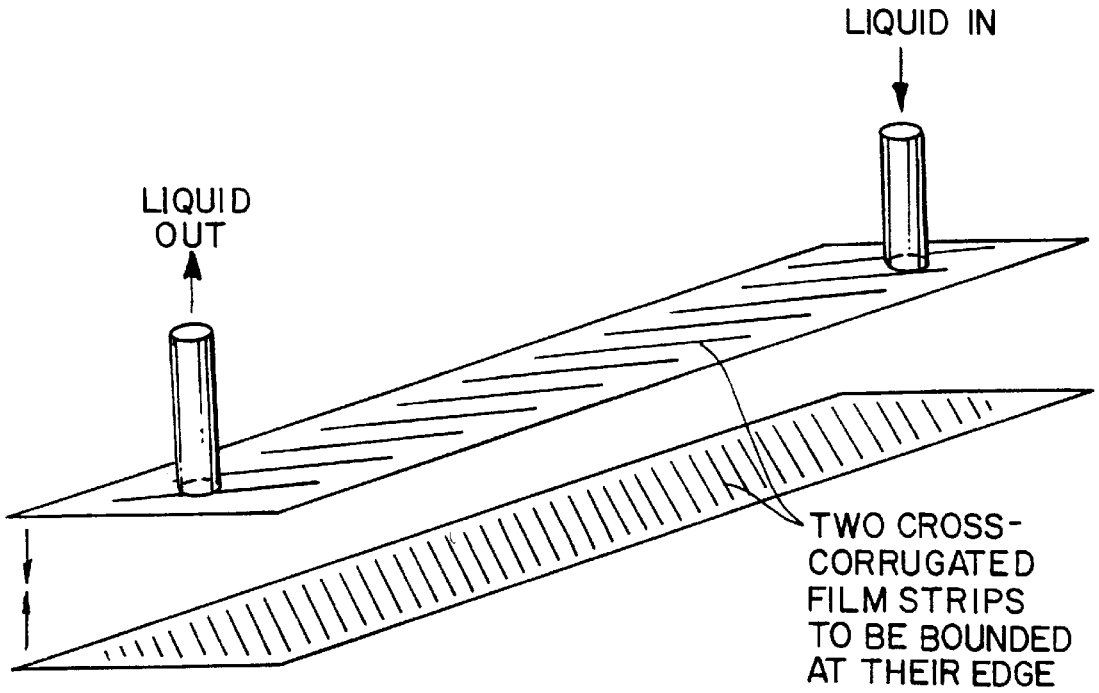
FIG. 1 shows an assembly arrangement for polymer bilayers.

Reference herein to matrix volume is to the total volume defined by the bilayer, including the volume defined by the external surface thereof, which is adapted to be contacted by first or second fluid, but excluding supply and effluent manifolds volume and deadspace, for example such as provided by a mandrel as hereinbelow described.

Gaseous and liquid fluids for heat exchanging purposes may be selected from any fluids conventionally employed for such purpose, in particular fluids to be cooled such as flue gases, engine, machinery, processing and furnace or motor coolants or the like, in particular for the recovery of heat energy, or for heat energy recovery purposes from hot waste fluids, such as washing machine or like domestic or industrial appliance effluent.

Suitably in the bilayer of the invention the path length of first fluid is less than the path length of second fluid. This is a particular advantage of the instance that the fluids are not the same, whereby one fluid is more susceptible to high pressure drop formation, for example is gaseous.

Preferably a bilayer as hereinbefore defined comprises two corrugated polymer films arranged at an angle of cross corrugation of 25° to 90°, more preferably arranged at an angle of 60° to 90° in the event the fluid flow paths are comprised substantially in a straight plane, or of 25° to 60° in the event that flow paths are comprised in a substantially curved or angled plane.

Corrugated polymer films may be comprised of any suitable polymer exhibiting thermoplastic properties, for example polyethylene such as polyethylene naphthalate (PEN), polypropylene, polyvinylchloride (PVC) and as hereinbefore defined (PEEK and UPILEX) having suitable working temperatures and flexibility and resilience. The films may comprise suitable fibre reinforcement and the like as is known in the art, preferably comprise carbon or glass fibre reinforcement. The films may be obtained precorrugated or may be corrugated in the process for the preparation of the bilayer using known techniques.

Corrugated polymer films may have any desired profile adapted to create and regulate a desired flow path therebetween, preferably may comprise a sinusoidal, saw tooth, square-sinusoidal profile or the like. Corrugation wavelength is conveniently measured in terms of peak to peak separation, and may be of any suitable value adapted for the desired heat exchanging duty and acceptable pressure drop, also adapted to allow for passage of any solid contaminants without blocking in the event that filtration is ineffective or undesirable. Preferably wavelength is of the order of up to lcm, more preferably in the range 1 to 6 mm, such as for example 2 to 4 mm. Choice of corrugation profile may conveniently be made with reference to the mixing and distribution characteristics required for a given application.

Angle of cross corrugation may suitably be selected according to mixing and distribution characteristics required for a given application, whereby a large cross-corrugation angle provides greater fluid flow path volume and hence less pressure drop, but less bilayer flexibility to desired deformation.

In a particular advantage of the present invention, a bilayer may be employed which occupies a small total matrix volume as hereinbefore defined, and yet which provides similar or superior fluid contacting with respect to conventional heat exchange elements.

A bilayer as hereinbefore defined may be elongate and formed into a geometric form whereof the longest dimension is less than the path length of second fluid, and whereby the number of discrete first fluid paths is greater than that which would be provided by a straight planar bilayer having the same longest dimension.

The geometric form of a bilayer may be selected according to the desired application, in particular with reference to the physical and mechanical constraints and volume to be accommodated.

It will be appreciated that a single bilayer is adapted for the passage of a first fluid and second fluid in cross directions, one of which is contained within the bilayer and thereby isolated from the other which contacts the outer surface of the bilayer, along the external corrugations thereof. Suitably therefore a bilayer is sealed in known manner at its periphery to contain the second fluid in suitable manner.

In a preferred embodiment a bilayer is formed into an open, closed or concentric spiral plane which is curved or angled, such as an elliptical, circular or polygonal plane or part or combination thereof. It will be appreciated that such bilayer may be one of a plurality of substantially coplanar bilayers arranged in coaxial, concentric or equivalent manner.

Reference to a concentric spiral plane which is curved or angled is to a plane which is coiled or wound in on itself in manner such that it forms a geometric body of which a cross section comprises a two-dimensional curved or angled spiral. Preferably such spiral and indeed an angled plane comprises continuous angles at each transition between spirals and each geometric angle respectively, thereby minimising the pressure drop along the second fluid path length.

The bilayers of the invention are thereby adapted for the selection of first fluid path length with reference to the number of coplanar bilayers or of concentric spirals thereof, ie comprising a substantially constant number of first fluid path lengths per bilayer or section, to obtain a desired cross sectional area of non-mixing contact of first and second fluid within a desired first fluid pressure drop constraint.

Suitably therefore a bilayer which is one of a plurality of corresponding bilayers or which comprises a concentric spiral is adapted to provide for passage of one of a first and second fluid enclosed within each separate bilayer or concentric portion thereof and isolated from the other of the first and second fluid which is adapted to pass between and contact the external surfaces of each of any two coplanar bilayers or concentric portions thereof, ie the plurality of corresponding bilayers or concentric portions thereof may be arranged in the first or second fluid flow path whereby the first or second fluid is able to pass therebetween, along the external corrugations thereof.

The bilayers of the invention are essentially scale independent, having regard to the ability to select the first fluid (and second fluid) path lengths thereof. For example a bilayer may have a total first fluid path length of 1 cm to 5 metres or more and a total second fluid path length of 10 cm to 50 metres or more, corresponding to a greatest geometric form dimension of 1 cm to 10 metres or more.

It will be appreciated that the pressure drop to which gaseous heat exchange fluids are susceptible is more severe than that to which liquid heat exchanging fluids are susceptible whereby physical constraints are substantially minimised by decreasing the gaseous fluid path length. It will also be appreciated that in the event that the pressure drop constraint of a heat exchanger in respect of both fluids is critical, it is preferred to employ a bilayer as hereinbefore defined which is formed into a part of a geometric form and is one of a plurality of corresponding end-to-end aligned bilayers defining a plane as hereinbefore defined, ie whereby the end-to-end path length of each bilayer is less than the curved or angled planar length of contact of first and second fluids.

A bilayer as hereinbefore defined may be formed with respective ends of the first and/or second fluid path associated with first and/or second fluid supply and effluent manifolds. Suitably a bilayer which is one of a plurality of substantially coplanar bilayers is associated with each of a single supply and effluent manifold common to each of the coplanar bilayers. Additionally, a bilayer which is formed into a part of a geometric form and is aligned end-to-end with one or more bilayers comprising the remaining parts of the geometric form, may be associated with each of a single supply and effluent manifold in common with co-aligned bilayers. Arrangement of manifolds will however be determined with reference to ease of access and connection consideration and the like.

In a further aspect of the invention there is provided a process for the preparation of a bilayer as hereinbefore defined comprising the assembly of two polymer films as hereinbefore defined, and the sealing thereof preferably two films are moulded to obtain the desired corrugation to obtain the desired configuration and simultaneously or otherwise are sealed and are formed to obtain the desired configuration as hereinbefore defined, preferably are simultaneously moulded to obtain the desired corrugation and geometric form. It will be appreciated that pre-corrugated film may be cut and formed as desired with minimal costs or that film may be corrugated and formed simultaneously with use of a dedicated template or die with associated higher product quality.

In a further aspect of the invention there is provided a fluid heat exchanger comprising a bilayer as hereinbefore defined. Suitably a heat exchanger as hereinbefore defined comprises a mandrel of corresponding form and dimensions to the space enclosed by the heat exchanger, adapted to be located in a first fluid flow path having corresponding form and dimensions adapted to enclose the heat exchanger.

It will be appreciated that the positioning of an axial mandrel within a heat exchanger positioned within the first fluid flow path as hereinbefore defined, ensures that the first fluid contacts the external surface(s) of the bilayer(s), ensuring effective heat exchange. The mandrel may be constructed of any suitable material, but is preferably constructed of a material matching the physical constraints of the intended application. Preferably the mandrel is hollow thereby reducing the mass thereof, more preferably is constructed of a resilient polymer, for example a thermoplastic polymer as hereinbefore defined, and has wall thickness sufficient to provide the required length.

In a further aspect of the invention there is provided the use of a heat exchanger as hereinbefore defined comprising a bilayer as hereinbefore defined for heat exchange application wherein the first fluid is gas and the second fluid is liquid, selected from fluids commonly employed in cooling heat exchange applications, such as flue gas, engine, machinery, furnace or motor coolants, waste industrial and domestic appliance effluents, and fluids commonly employed for the recovery of heat energy therefrom.

According to the present invention a corrugated polymer film heat exchanger matrix is provided, constructed for example as described below, having one or more of the following principle advantages:

1. It is conveniently manufactured by bonding only two film layers together, rather than multiple layers in a matrix.
2. The flow path length for one fluid (ie the gas) may be made very short.
3. Manifold arrangements for each fluid are very simple, particularly if the matrix is contained within one of the fluid (gas) ducts.
4. If modest tension is applied to the corrugated strips during the winding process, then the spiral matrix will be mechanically robust and resist pressure forces generated in the liquid coolant.

A secondary heat exchanger for a 15 kW condensing domestic water heater is typically designed to recover 3 kW by cooling the flue gas from 250° C. to 50° C. (approximately) with water entering at 50° C. This corresponds to a mean temperature difference of about 80° C. Noting that the overall heat transfer coefficient attainable with the corrugated polymer film heat exchanger is about 200 $W/m^2K$, the heat transfer area required for this duty is 0.2 $m^2$. It is proposed to generate this area by bonding two corrugated strips 10 cm wide and 1m long at their periphery as shown in FIG. 1. The corrugations are aligned at 45° C. to the strip length but cross at 90° in order to hold the strips apart. Thus a flow channel is created for the water which passes between the inlet/outlet ports provided at each end.

Figure 2:
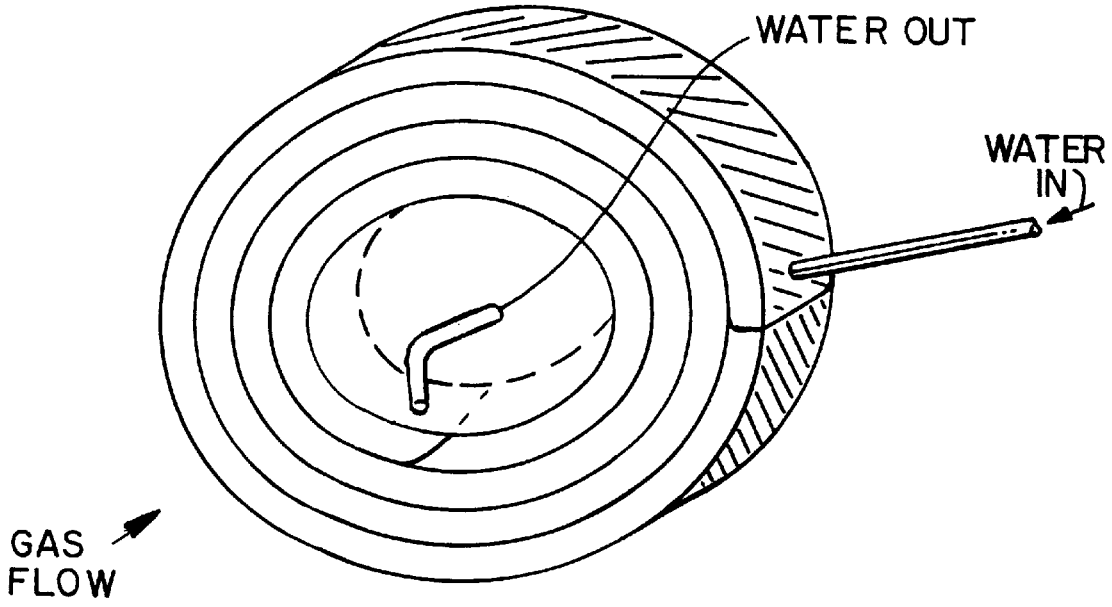
FIG. 2 is a perspective view of an arrangement of the spiral bilayer.

The polymer strip is then wound on a cylindrical mandrel having a diameter large enough to avoid "kinking" of the channel as the spiral matrix is generated. With 100 $\mu$m thick corrugated PEEK film this diameter will typically be at least 7 cm. After winding, the heat exchanger spiral is secured by a restraining cylindrical band, thereby generating a heat exchanger cartridge which may conveniently be installed in a gas duct. A one metre strip corrugated as described above will wind into a spiral approximately 7 cm inner diameter and 9 cm outer diameter. As will be seen from FIG. 2 in this case the central mandrel is blocked in order that the gas is compelled to flow between the liquid-cooled spiral strips giving a flow path length of 10 cm.

Clearly, if a shorter gas flow path length is required in order to reduce pressure drop further, narrower strips may be wound to produce a cartridge of larger outside diameter.

Figure 3:
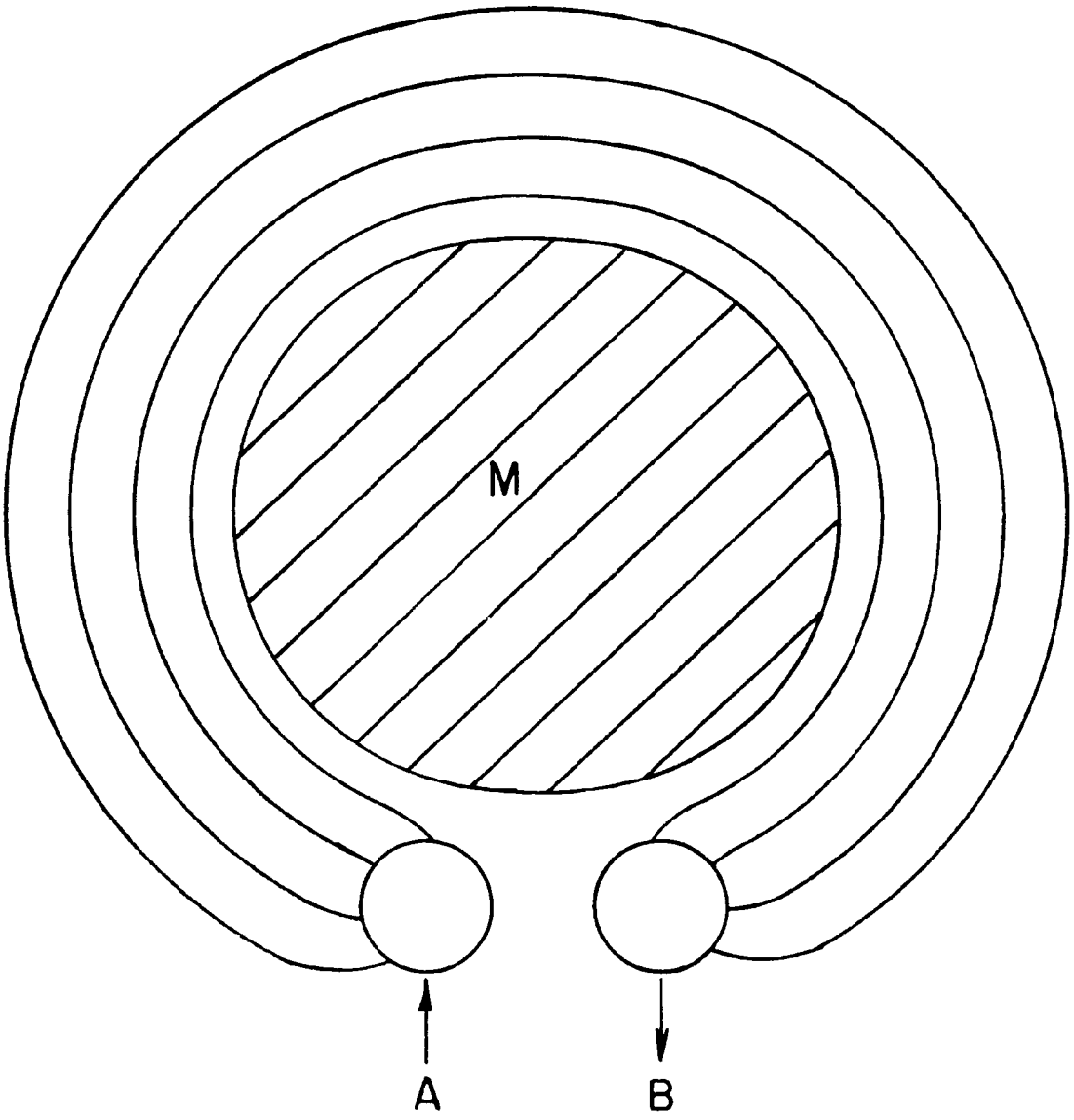
FIG. 3 is a horizontal cross-section through heat exchanger with parallel waterflow.

Alternatively if the liquid pressure drop must be reduced (as in the case of automobile radiators or aircraft oil coolers), the water flow to several strips may be connected in Parallel. FIG. 3 shows the envisaged arrangement with four strips which have common water feed and return headers, A,B. The strips are wound around the mandrel M which is of such diameter as to prevent "kinking" of the strips. The length of each strip is cut so as to ensure that each is in snug contact with its neighbour along its entirety. The location and bonding of the ends of the strips into the headers is a straightforward matter to those skilled in the art of polymer fabrication.

Figure 4A:
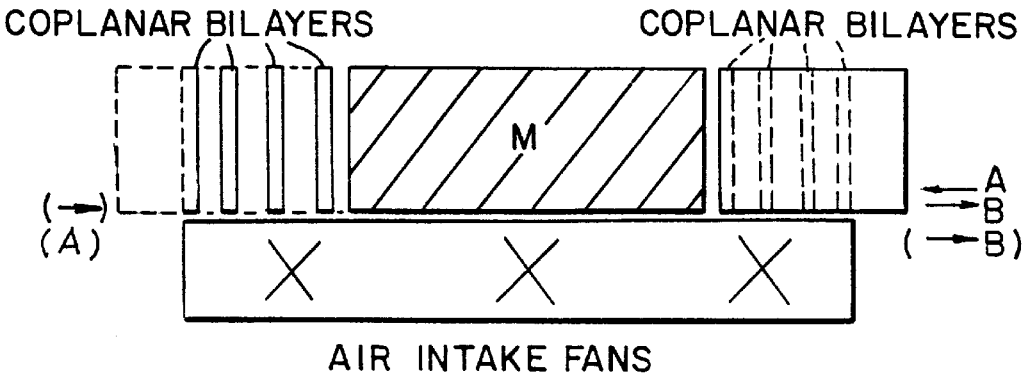
FIG. 4 is a vertical cross-section through and plan view of water effluent cooling heat exchanger.
Figure 4B:
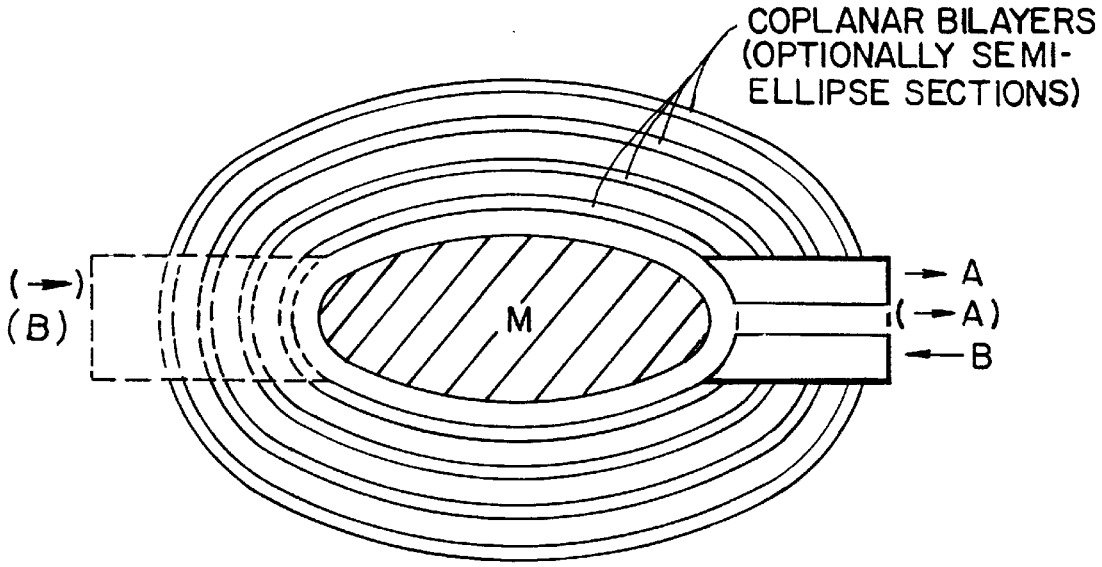

In FIG. 4 is shown a heat exchanger as described in respect of FIG. 3, for use in cooling water effluent from power generation turbines, processing plants and the like. Traditional cooling towers are thereby dispensed with and dry cooling is employed, eliminating the present evaporation waste problems. The heat exchanger of FIG. 4 may be 50 m diameter or more, whereby cross-corrugation angles of 90° are found to be satisfactory.

Using the 100 $\mu$m thick corrugated PEEK film tests were carried out to study the heat transfer and pressure drop characteristics for gas/gas, liquid/liquid and gas/liquid duties and for different angles of cross corrugation (eg 90°, 60° and 30°). The objective of the investigation was to obtain design data in the form of $J_h$ (Colbum factor) and f (fanning friction factor) correlation's as an indication of heat transfer characteristics and pressure drop respectively. From the above mentioned studies it was concluded that for a spiral polymer film heat exchanger the angle of cross corrugation is likely to be between 60 and 30° as it allows the polymer strip to be easily wound around the mandrel. It was also revealed that the shape of the mandrel may not necessarily be cylindrical. For example if the spiral exchanger is used as a car radiator then the mandrel is more likely to be ellipsoid than cylindrical in shape.

We claim:

1. A bilayer of polymer film arranged in manner to create respective flow paths for a first and second gaseous or liquid fluid, wherein the ratio of the surface area of polymer film adapted to contact and thereby isolate both fluids to the total matrix volume, defined as the total volume of the bilayer, including that at the external surface thereof, which is adapted to be contacted by first or second fluid, is in excess of 700 $ml/m^3$.

2. A bilayer according to claim 1 wherein the path length of first fluid is less than the path length of second fluid.

3. A bilayer according to claim 1 comprising two corrugated polymer films arranged at an angle of cross corrugation of 25° to 90°.

4. A bilayer according to claim 1 which is elongate and is formed into a geometric for whereof the longest dimension is less than the path length of second fluid, and whereby the number of discrete first fluid paths is greater than that which would be provided by a straight planar bilayer having the same longest dimension.

5. A bilayer according to claim 1 which is formed into an open, closed or concentric spiral plane which is curved or angled, such as an elliptical, circular or polygonal plane or part or combination thereof.

6. A bilayer according to claim 1 which is one of a plurality of substantially coplanar bilayers arranged in coaxial, concentric or equivalent manner.

7. A bilayer according to claim 1 which is formed with respective ends of the first and/or second fluid path associated with first and/or second fluid supply and effluent manifolds.

8. A bilayer according to claim 1 which is a fluid heat exchanger.

9. A bilayer according to claim 8 which comprises a mandrel of corresponding form and dimensions to the space enclosed by the heat exchanger, adapted to be located in a first fluid flow path having corresponding form and dimensions adapted to enclose the heat exchanger.

10. The bilayer of claim 1 for use in heat exchange application wherein the first fluid is gas and the second fluid is a liquid selected from the group consisting of flue gas, engine coolants, machinery coolants, furnace coolants, motor coolants, waste industrial and domestic appliance effluents, and fluids commonly employed for the recovery of heat energy therefrom.

11. A process for the preparation of a bilayer of polymer film comprising:

arranging two polymer films to form a bilayer in such a manner that said bilayer is capable of creating respective flow paths for a first and second gaseous or liquid fluid and wherein the ration of the surface area of the polymer films that is capable of contacting and thereby isolating both fluids to the total matrix volume which is defined as the total volume of the bilayer including the external surface thereof is greater than 700 $m^2/m^3$, and sealing both of said polymer films.

12. The process of claim 11 comprising molding said two polymer films such that each of said polymer films is corrugated.

13. The process of claim 11, further comprising forming the bilayer to the desired configuration.

* * * * *

UNITED STATES PATENT AND TRADEMARK OFFICE

CERTIFICATE OF CORRECTION

PATENT NO. : 6,059,024
DATED : May 9, 2000
INVENTOR(S) : Ramshaw et al.

It is certified that error appears in the above-identified patent and that said Letters Patent is hereby corrected as shown below:

Title page,
Line 1, change "3,216,492 11/1965" to -- 3,126,492 7/1961 --.

Column 1,
Line 31, after "corrugations" delete -- . --.

Column 6,
Line 40, change "ml" to -- $m^2$ --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*